US006043434A

United States Patent [19]

Prudhon

[11] Patent Number: 6,043,434

[45] Date of Patent: Mar. 28, 2000

[54] FLAT CABLE FOR TRANSMITTING HIGH BIT RATE SIGNALS

[75] Inventor: Daniel Prudhon, Fumay, France

[73] Assignee: Alcatel, Paris, France

[21] Appl. No.: 09/057,544

[22] Filed: Apr. 9, 1998

[30] Foreign Application Priority Data

Apr. 10, 1997 [FR] France ..... 97 04403

[51] Int. Cl.[7] ..... H01B 7/00

[52] U.S. Cl. ..... 174/113 R; 174/117 R; 174/117 F

[58] Field of Search ..... 174/36, 117 F, 174/117 FF, 115, 113 R

[56] References Cited

U.S. PATENT DOCUMENTS

| | | | |
|---|---|---|---|
| 3,584,132 | 6/1971 | Brauns | 174/34 |
| 3,663,739 | 5/1972 | Chevrier | 174/36 |
| 4,155,613 | 5/1979 | Brandeau | 339/29 R |
| 4,321,425 | 3/1982 | Emmel | 174/32 |
| 4,481,379 | 11/1984 | Bolick et al. | 174/36 |
| 4,777,325 | 10/1988 | Siwinski | 174/34 |
| 5,767,441 | 6/1998 | Brorein et al. | 174/27 |
| 5,821,467 | 10/1998 | O'Brien et al. | 174/117 |

*Primary Examiner*—Kristine Kincaid
*Assistant Examiner*—William H Mayo, III
*Attorney, Agent, or Firm*—Sughrue, Mion, Zinn, Macpeak & Seas, PLLC

[57] ABSTRACT

The invention relates to a flat cable for transmitting high bit rate signals including at least one pair of individually insulated conductors, a layer having at least one groove and a conductive grounding member located on the surface of each groove. This cable includes two conductors each individually twisted with a short lay and thus maintained juxtaposed in the same groove of the layer. Application to cables for local area networks of computers working at frequencies that can attain 100 MHz.

6 Claims, 1 Drawing Sheet

FLAT CABLE FOR TRANSMITTING HIGH BIT RATE SIGNALS

BACKGROUND OF THE INVENTION

1. Field of the Invention

The invention relates to a flat cable for transmitting high bit rate signals comprising at least one pair of conductive wires.

2. Description of the Prior Art

Flat cables used in information technology in the form of a ribbon made of plastics material in which a number of parallel conductors are encased are already known. These cables are produced by extruding the plastics casing material simultaneously around all the conductors. Sometimes the plastics casing material is applied to conductors that are already insulated. It is observed that the conductors are not centered properly, because it is very difficult to achieve a precise positioning of all the conductors in such an extruded ribbon. Consequently, these cables can be used only over a short length, not exceeding a few tens of centimeters, and at relatively low frequencies, in general in the order of a few kilohertz but practically always less than 10 MHz. However, it is preferable to use these flat cables when their use is possible, because the regular disposition of the conductors enables the use of simple insulation displacement connectors which can be fitted very quickly.

In addition, U.S. Pat. No. 3,663,739 describes a flat cable in which the position of the conductive wires with respect to each other can be better. According to this document, a layer is made with ribs that delimit grooves. The surfaces of the grooves and of the layers are covered with a conductive grounding member and insulated conductive wires are seated in the grooves with one conductive wire in each groove. The grooves are then closed, preferably by an additional conductive member. Thus, each conductive wire can be considered as separately shielded.

Such a flat cable which can be used with a simple insulation displacement connector, nevertheless has a drawback. Although the shielding of the separate conductive wires enables crosstalk to be reduced through the electromagnetic protection obtained, there is a capacitive effect between the conductors when they are poorly centered in their insulation.

This drawback is described in detail because it limits the frequencies at which the flat cable can be used. In this flat cable, there is capacitance between each conductor and the ground coating formed over the grooves and the ribs. If all the conductors were truly equidistant from this ground plane, there would be no unbalancing capacitive effect between the conductors. On the other hand, since the conductors are always locally more or less off center in their own insulation, their capacitive effects differ from one conductor to another with respect to a ground plane. A crosstalk phenomenon then appears.

The use of twisted cables with several pairs of conductive wires for the implementation of local area networks is also known to the art. These cables avoid crosstalk the main cause of which is capacitive unbalance between the conductors of different pairs, the conductors and ground. Capacitive unbalance is reduced by the effect of the twists which provide a symmetry. However, these twisted cables have a very important drawback because they do not allow the use of insulation displacement connectors, so that the costs of connecting and laying these cables are of the same order of magnitude as the costs of the cables and their connectors. In addition, laying these twisted cables along partition walls is unsightly because they are very thick.

SUMMARY OF THE INVENTION

An aim of the invention is to enable the use of flat cables for implementing local area networks of great lengths, in the order of 100 m, with high bit rates, at frequencies that can attain 100 MHz. For this, the invention uses means that reduce the capacitive effects of the shielded flat cables by twisting each solid conductor and by associating the conductive wires of each pair so that they are closer to each other than the conductive wires of the other pairs.

More precisely, the capacitive effects presented by each conductor with respect to the ground plane are compensated by using conductors each twisted on its own axis. The effects of crosstalk between the conductors of different pairs are then reduced by positioning the conductors of the same pair closer together than conductors belonging to different pairs.

Thus an object of the invention is a flat cable for transmitting high bit rate signals, comprising at least one pair of conductive wires each comprising a conductor and an insulator, a layer having at least one groove delimited by ribs and a conductive grounding member located at least on the surface of each groove, this cable including two conductive wires each individually twisted on its own axis with a lay much lower than the wavelength of the signals to be transmitted and thus maintained juxtaposed in the same groove.

In an advantageous embodiment, the lay varies from one conductive wire to the other in the same pair and/or over the length of each conductive wire within the range 10 mm to 50 mm.

In another embodiment, the conductive grounding member is a metallized ribbon encircling each pair. In another embodiment, the conductive ground member is a coating on the surfaces of the grooves and the ribs, formed for example by electrodeposition.

In one application of the cable, comprising at least two pairs of conductive wires and intended to be fitted with an insulation displacement connector, the cable is such that the spacing of the two conductive wires of the same pair is substantially less than half the spacing of the conductive wires of different pairs.

Further advantages and features of the invention will emerge from the more detailed description that follows with reference to the appended drawings.

DETAILED DESCRIPTION OF THE PREFERRED EMBODIMENTS

Figure 1:
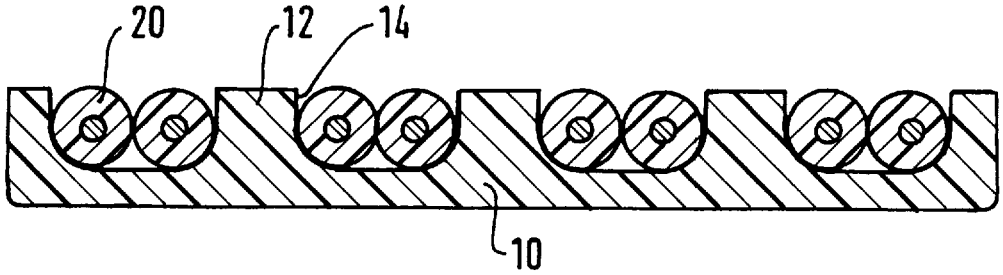
FIG. 1 depicts a metallized layer containing conductive wires forming part of a cable in accordance with the invention.

The capacitive phenomena between conductors will first be examined. When a conductor is placed at a certain distance from a ground plane, there is capacitance between the conductor and the ground plane. When several conductors are placed at different distances from a ground plane and transmit signals, the capacitances formed by each conductor and the ground plane are charged. When the capacitances of different conductors are not the same, an unbalance appears with respect to ground, and this unbalance creates a crosstalk phenomenon called "third circuit crosstalk"; the capacitive unbalances of each of the pairs with respect to ground create a coupling between them through the intermediary of this ground. When high frequency signals are circulating, this crosstalk phenomenon disturbs the signals of the different conductors. However, if all the capacitances are the same, their unbalances cancel out and no crosstalk tends to appear between adjacent conductors.

In order to reduce the capacitive unbalances causing crosstalk and to be able to use the high frequencies at which these effects are significant and which can attain for example 100 MHz, it is therefore important to obtain capacitances that are as equal as possible. It is already known to use very homogeneous materials and very regular diameters for the insulation of the conductive wires. However, it is not possible to achieve perfect centering of the conductor within its insulation. The invention enables this drawback to be remedied by twisting each separate conductor so that, through a symmetry effect, the conductor is, on average over a certain distance, perfectly centered in its insulation. In this way, taking into account the substantially constant diameter of the different conductors, the average distance between a conductor and a ground plane can be constant throughout the length of the conductive wire, and the capacitances formed by each conductor with the ground plane have the same value, so that capacitive crosstalk phenomena are eliminated or at least considerably attenuated.

So that twisting of the conductors eliminates the greatest part at least of the capacitive effects, it is necessary for the lay to be very much lower than the wavelength at the frequencies used. For example for transmitting signals at frequencies of up to 100 MHz, a lay of less than 50 mm is required.

Consequently, according to an essential feature of the invention, the conductor is subjected to twisting. In one embodiment, this twisting is introduced at the conductor production stage. However, taking into account the high speeds of the conductor in industrial production installations, it is difficult to achieve such twisting. In another embodiment, the twisting is applied to the conductive wire, which has already been insulated, for example at the point of entry to a machine for laying conductive wires in a cable layer in accordance with the invention.

The conductor is preferably made of copper, preferably having a diameter in the range 0.5 mm to 0.65 mm, and the conductive wire, including the insulation, has a diameter in the range 1.2 mm to 2 mm, the insulation consisting for example of solid or cellular polyethylene or any other material with a low dielectric constant (less than 3.5) and a loss angle of less than 0.01 at 100 MHz.

FIG. 1 depicts a layer 10, for example made of extruded polyvinylchloride, which delimits ribs 12 between which are formed grooves 14 each designed to hold two conductive wires. In one embodiment, the layer comprises four grooves designed to hold four pairs of wires. However, it can contain any number of grooves, and therefore pairs, for example a cable for a local area network can contain two.

Figure 2:
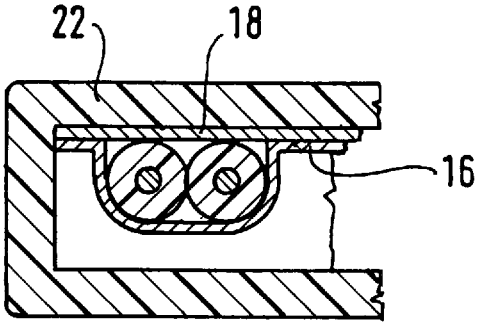
FIG. 2 depicts a finished cable implemented from the layer in FIG. 1.

As depicted in FIG. 2, the grooves 14 include a conductive coating 16 which can be formed from a separate aluminum foil, or a metallization applied for example by electrodeposition with a conductive ink or by vacuum metallization. A metallic or metallized polyester foil 18 is placed over the conductive wires 20 so that they are shielded. A sheath 22 encircles the layer and the conductive wires. The total thickness of the cable is in the range 2 mm to 3 mm in the example considered.

It can be seen in FIGS. 1 and 2 that, in an advantageous embodiment, the two conductive wires of each pair are contained in a single groove. Preferably, the width of the groove is such that the two wires of the pair are tight up against each other.

The conductors are twisted individually on their own axes with a short lay, which varies from one conductor to the other of the same pair and/or over their length. In this way, at each point in the length of the cable, the two conductors of each pair have a different lay. Two conductive wires of the same pair are thus juxtaposed in the same groove to give greater symmetry over their length thereby avoiding crosstalk problems created by unbalances to ground.

Figure 3:
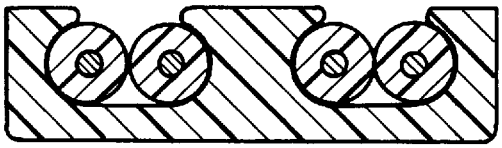
FIG. 3 depicts a variant of the layer which can be used in a cable in accordance with the invention.
Figure 4:
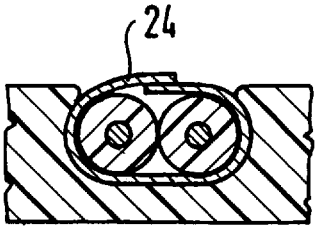
FIG. 4 depicts a detail of an embodiment of a variant of the invention.

FIG. 3 depicts, in the case of a cable with two pairs only, ribs having projections overhanging the grooves and enabling better retention of the conductive wires. FIG. 4 shows that each pair of conductive wires could be coated with a conductive ribbon 24, for example polyester metallized with aluminum, forming a conductive ground member, so that the aluminum foil or metallization 16 on the one hand, and the metallic or metallized polyester foil 18 on the other hand, depicted in FIG. 2, are no longer needed.

The flat cables in accordance with the invention have the advantage, given by all flat cables, of being able to be connected by insulation displacement connectors which require a very short time for connecting the various devices and accessories connected. In addition, when the cable has the disposition depicted in FIG. 1, in other words when the two conductive wires of a pair are closer together than those of adjacent pairs, the insulation displacement contacts designed to cooperate with the two conductive wires of a pair are closer than the contacts which cooperate with the conductive wires of adjacent pairs. In this way, crosstalk phenomena in the connectors can be further attenuated.

The flat cable in accordance with the invention, when it has the features indicated hereinabove, can be used to install local area networks conforming to the class D network specifications in accordance with the ISO/IEC 11801 and EN 50173 standards, in other words capable of being used over distances in the order of 100 m at frequencies of 100 MHz. The lay of each conductor about its own axis is then in the range 10 mm to 50 mm.

The main advantages of the cable in accordance with the invention compared with the twisted pair cables currently used in the application considered, are 1) that it is not necessary to untwist each pair and then to connect the conductive wires one at a time, since insulation displacement connectors enable almost instantaneous connections to be made by relatively unskilled workers, so that the cost of skilled workers is considerably reduced, and
2) that it is possible to dispose the flat cable against walls and partitions conveniently and esthetically, for example with adhesive, taking up little thickness.

It goes without saying that the invention as described and depicted is merely a preferred example and that all technically equivalent embodiments of its component elements could be encompassed without departing from its scope.

There is claimed:

1. A flat cable for transmitting high bit rate signals, comprising at least one pair of conductive wires each comprising a conductor and an insulator, a layer having at least one groove delimited by ribs and a conductive grounding member located at least on the surface of said at least one groove, wherein each of said conductive wires of said at least one pair of conductive wires is individually twisted about its own axis with a lay much lower than the wavelength of signals to be transmitted such that said at least one pair of conductive wires are maintained juxtaposed, but untwisted with respect to each other, in said at least one groove.

2. The cable claimed in claim 1 for transmitting signals with a frequency of 100 MHz or less wherein the lay of each conductive wire of said at least one pair of conductive wires is in range of 10 mm to 50 mm.

3. The cable claimed in claim 1 wherein the lay varies from one conductive wire to an adjacent conductive wire in the at least one pair of conductive wires, and over a length of each conductive wire within a range of 10 mm to 50 mm.

4. The cable claimed in claim 1 wherein said conductive grounding member is a metallized ribbon encircling each pair.

5. The cable claimed in claim 1 wherein said conductive grounding member is a coating on the surface of said at least one groove and on said ribs.

6. A cable as claimed in claim 1 comprising at least two pairs of conductive wires wherein the spacing of said two conductive wires of a same pair is substantially less than half the spacing of said conductive wires of different pairs.

* * * * *